US010690098B2

(12) United States Patent
Matsumoto

(10) Patent No.: US 10,690,098 B2
(45) Date of Patent: Jun. 23, 2020

(54) HIGH-PRESSURE PUMP

(71) Applicant: DENSO CORPORATION, Kariya, Aichi-pref. (JP)

(72) Inventor: Teppei Matsumoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 245 days.

(21) Appl. No.: 15/740,100

(22) PCT Filed: May 13, 2016

(86) PCT No.: PCT/JP2016/002359

§ 371 (c)(1),
(2) Date: Dec. 27, 2017

(87) PCT Pub. No.: WO2017/002297

PCT Pub. Date: Jan. 5, 2017

(65) Prior Publication Data

US 2018/0187637 A1 Jul. 5, 2018

(30) Foreign Application Priority Data

Jun. 30, 2015 (JP) ..... 2015-130993

(51) Int. Cl.
*F02M 59/44* (2006.01)
*F02B 9/04* (2006.01)
(Continued)

(52) U.S. Cl.
CPC ..... *F02M 59/442* (2013.01); *F02M 59/102* (2013.01); *F02M 59/44* (2013.01);
(Continued)

(58) Field of Classification Search
CPC .. F02M 59/44; F02M 2200/02; F02M 59/102; F02M 59/442; F02M 59/46; F02M 59/02; F02M 59/025; F02M 59/48; F02M 63/0001; F04B 1/0426; F04B 9/04; F04B 9/042; F04B 1/0439; F04B 53/14;
(Continued)

(56) References Cited

U.S. PATENT DOCUMENTS 2,112,660 A * 3/1938 Hudson ..... F41A 3/46 89/149
2,322,356 A * 6/1943 Hahn ..... F02M 59/48 417/494

(Continued)

*Primary Examiner* — Devon C Kramer
*Assistant Examiner* — Benjamin Doyle
(74) *Attorney, Agent, or Firm* — Nixon & Vanderhye P.C.

(57) ABSTRACT

In a high-pressure pump, a center of load in a virtual plane including an end face of a coil spring facing a pressurizing chamber in an axial direction is defined as an upper load center, and a center of load in a virtual plane including an end face of the coil spring facing a cam in the axial direction is defined as a lower load center. The coil spring is configured such that, when viewed in the axial direction, during motion of a plunger toward the pressurizing chamber by rotation of the cam, the upper load center moves in one direction along a circumference of the coil spring while the lower load center moves in an opposite direction along the circumference of the coil spring, and the lower load center substantially coincides with the upper load center and subsequently further moves in the opposite direction.

3 Claims, 9 Drawing Sheets

(51) Int. Cl.
*F02M 59/10* (2006.01)
*F02M 59/46* (2006.01)
*F04B 1/0426* (2020.01)
*F04B 9/04* (2006.01)

(52) U.S. Cl.
CPC ..... *F02M 59/46* (2013.01); *F04B 1/0426* (2013.01); *F04B 9/04* (2013.01); *F04B 9/042* (2013.01); *F02M 2200/02* (2013.01)

(58) Field of Classification Search
CPC ..... F04B 15/02; F04B 1/0408; F04B 1/0413; F04B 1/0421; F04B 53/143; F04B 53/162; F04B 7/0057; F16J 15/56; Y10T 74/2107
USPC ..... 92/85 A, 130 R; 417/470; 267/167, 166, 267/166.1, 170, 174–179
See application file for complete search history.

(56) References Cited

U.S. PATENT DOCUMENTS 2,695,169 A * 11/1954 Keysor ..... F16F 1/06 267/166
5,454,150 A * 10/1995 Hinke ..... B21F 35/00 267/166
5,775,203 A * 7/1998 Osborn ..... F02M 59/102 417/470
5,911,295 A * 6/1999 Itonaga ..... F16D 25/0638 192/70.28
6,712,346 B2 * 3/2004 Imaizumi ..... B60G 3/06 267/286
7,794,216 B2 * 9/2010 Kitamura ..... F02M 63/0001 417/470
8,490,285 B2 * 7/2013 Knebel, III ..... F16F 1/043 267/167
8,820,300 B2 * 9/2014 Aritomi ..... F02M 59/102 123/495
9,322,447 B2 * 4/2016 Okura ..... F16F 1/02
10,155,425 B2 * 12/2018 Nishizawa ..... B60G 11/14
2003/0161746 A1 * 8/2003 Asayama ..... F02M 39/00 417/470
2005/0100466 A1 * 5/2005 Aoki ..... F02M 59/102 417/533
2006/0038332 A1 * 2/2006 Pare ..... F16F 1/126 267/179
2006/0061024 A1 * 3/2006 Jung ..... F04B 35/045 267/167
2009/0097997 A1 * 4/2009 Suzuki ..... F02M 59/462 417/470
2009/0230602 A1 * 9/2009 Takamura ..... F01L 1/462 267/174
2012/0180764 A1 7/2012 Aritomi et al.
2012/0251366 A1 * 10/2012 Kuroyanagi ..... F04B 49/035 417/440
2015/0369190 A1 * 12/2015 Ropertz ..... F02M 59/025 417/437
2016/0025054 A1 1/2016 Kuroyanagi et al.
2016/0245248 A1 * 8/2016 Ando ..... F02M 59/102

* cited by examiner

HIGH-PRESSURE PUMP

CROSS REFERENCE TO RELATED APPLICATION

This application is the U.S. national phase of International Application No. PCT/JP2016/002359 filed May 13, 2016 which designated the U.S. and claims priority to Japanese Patent Application No. 2015-130993 filed on Jun. 30, 2015, the entire contents of each of which are hereby incorporated by reference.

TECHNICAL FIELD

The present disclosure relates to a high-pressure pump which pressurizes and discharges fuel.

BACKGROUND ART

Conventionally, a high-pressure pump has been known, which is mounted on a vehicle and pressurizes and supplies a fuel to an internal combustion engine. The high-pressure pump disclosed in Patent Literature 1 includes a bottomed cylindrical cylinder, a plunger, and a coil spring. The plunger is disposed to reciprocate inside the cylinder, and defines a pressurizing chamber between an outer wall on one end of the plunger and an inner wall of the cylinder. The coil spring is provided radially outward of another end of the plunger and is capable of urging the other end of the plunger away from the pressurizing chamber and pressing the other end against a cam of a driven shaft of the internal combustion engine.

In the high-pressure pump of Patent Literature 1, gaps are provided between a retainer locking an end portion of the coil spring and the other end of the plunger and between a tappet provided between the retainer and the cam and the other end of the plunger. The gaps prevent radial force from acting on the plunger from the coil spring when the plunger reciprocates. As a result, a surface pressure of a sliding interface between the outer wall of the plunger and the inner wall of the cylinder is reduced, thereby reducing load acting on the plunger.

However, in the high-pressure pump of Patent Literature 1, when the plunger reciprocates, only a specific portion of the sliding interface between the plunger and the cylinder may slide. In that case, an oil film breakage occurs at the specific portion, which may cause uneven wear and burnout of the plunger and the cylinder.

PRIOR ART LITERATURE

Patent Literature

Patent Literature 1: JP 5337824

SUMMARY

The present disclosure has been made in view of the above points, and an object of the present disclosure is to provide a high-pressure pump capable of reducing uneven wear and burnout between a plunger and a cylinder with a simple configuration.

According to an aspect of the present disclosure, a high-pressure pump pressurizes and supplies a fuel to an internal combustion engine, and includes a cylinder, a plunger and a coil spring. The cylinder includes a cylinder cylindrical portion having a cylindrical shape. The plunger has a rod shape and has one end disposed to be reciprocable inside the cylinder cylindrical portion. The plunger defines a pressurizing chamber for pressurizing the fuel between an outer wall of the one end and an inner wall of the cylinder. The coil spring is formed of a wire wound in a coil shape and disposed radially outward of another end of the plunger. The coil spring urges the other end of the plunger away from the pressurizing chamber and is capable of pressing the other end of the plunger against a cam of a driven shaft of the internal combustion engine.

In the above aspect of the present disclosure, the center of load in the virtual plane including the end face of the coil spring facing the pressurizing chamber in the axial direction is defined as the upper load center, and the center of load on the virtual plane including the end face of the coil spring facing the cam in the axial direction is defined as the lower load center. When viewed in the axial direction, during motion of the plunger toward the pressurizing chamber by the rotation of the cam, the upper load center moves in the one direction along the circumference of the coil spring, and the lower load center moves in the opposite direction along the circumference of the coil spring, and the lower load center substantially coincides with the upper load center and subsequently further moves in the opposite direction. For that reason, when the plunger moves from a bottom dead center toward the pressurizing chamber, a force acting on the plunger from the coil spring in a radial direction reverses after having reached zero once. As a result, the plunger moves toward the pressurizing chamber with tilting its axis.

Also, with the above configuration, when the plunger moves from the top dead center toward the cam, the force acting on the plunger from the coil spring in the radial direction reverses after having reaching zero once. For that reason, the plunger moves toward the cam with tilting its axis. In other words, according to the present disclosure, the plunger swings so that its axis tilts when the plunger reciprocates inside of the cylinder cylindrical portion. As a result, it is possible to prevent sliding of a specific portion of the outer wall of the plunger on a specific portion of the inner wall of the cylinder cylindrical portion. Further, a size of a gap between the outer wall of the plunger and the inner wall of the cylinder cylindrical portion changes continuously, and an oil film is always formed in the gap. Therefore, uneven wear and burnout between the plunger and the cylinder can be reduced.

DESCRIPTION OF EMBODIMENTS

Hereinafter, a high-pressure pump according to embodiments of the present disclosure will be described with reference to the drawings.

Embodiment

Figure 2:
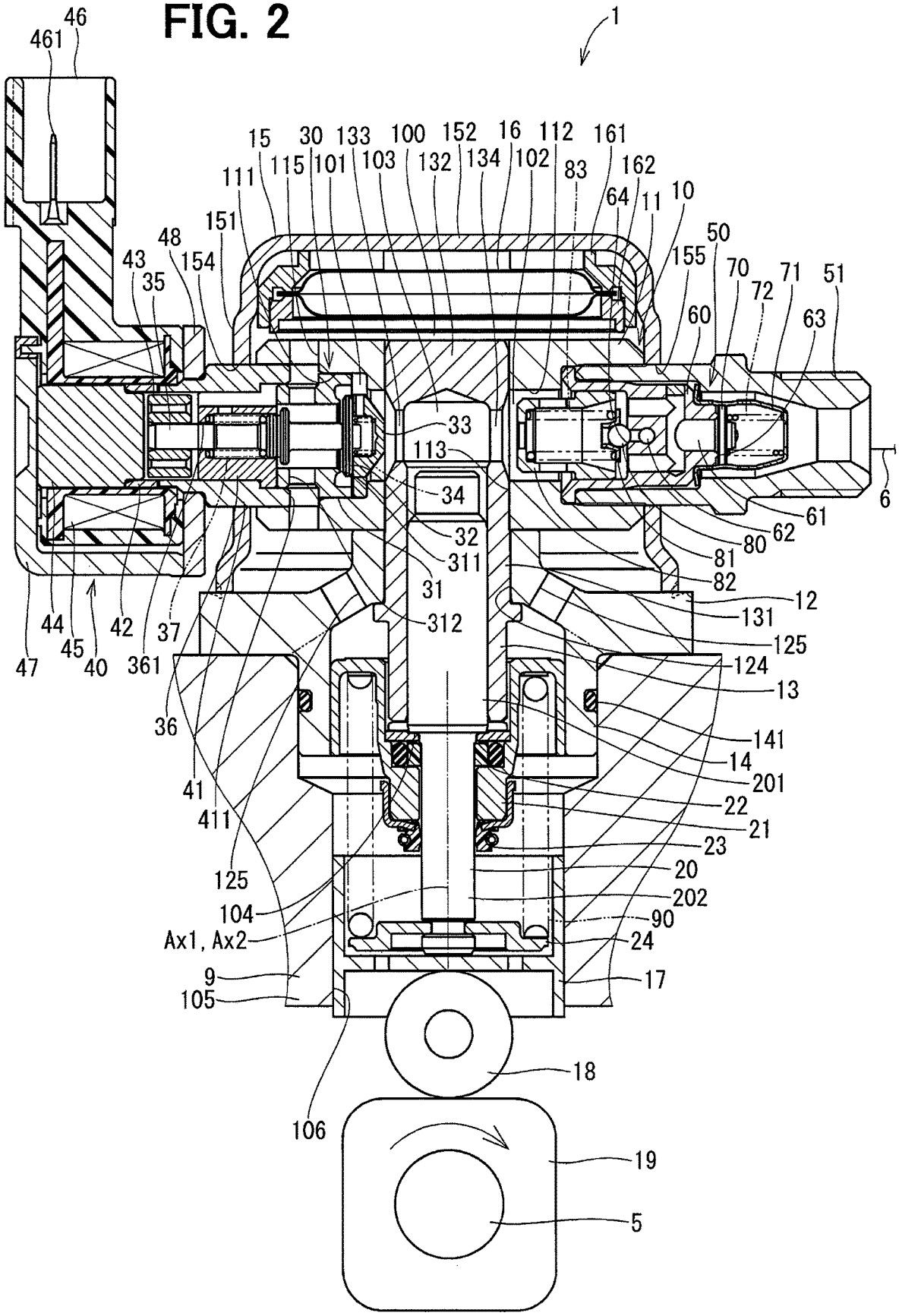
FIG. 2 is a cross-sectional view showing the high-pressure pump according to the embodiment.

A high-pressure pump according to an embodiment of the present disclosure is illustrated in FIG. 2.

A high-pressure pump 1 is provided in a vehicle not shown. The high-pressure pump 1 is a pump that supplies a fuel at a high pressure to an engine 9, for example, as an internal combustion engine. The fuel to be supplied to the engine 9 by the high-pressure pump 1 is, for example, gasoline. In other words, a fuel supply target of the high-pressure pump 1 is a gasoline engine.

Figure 1:
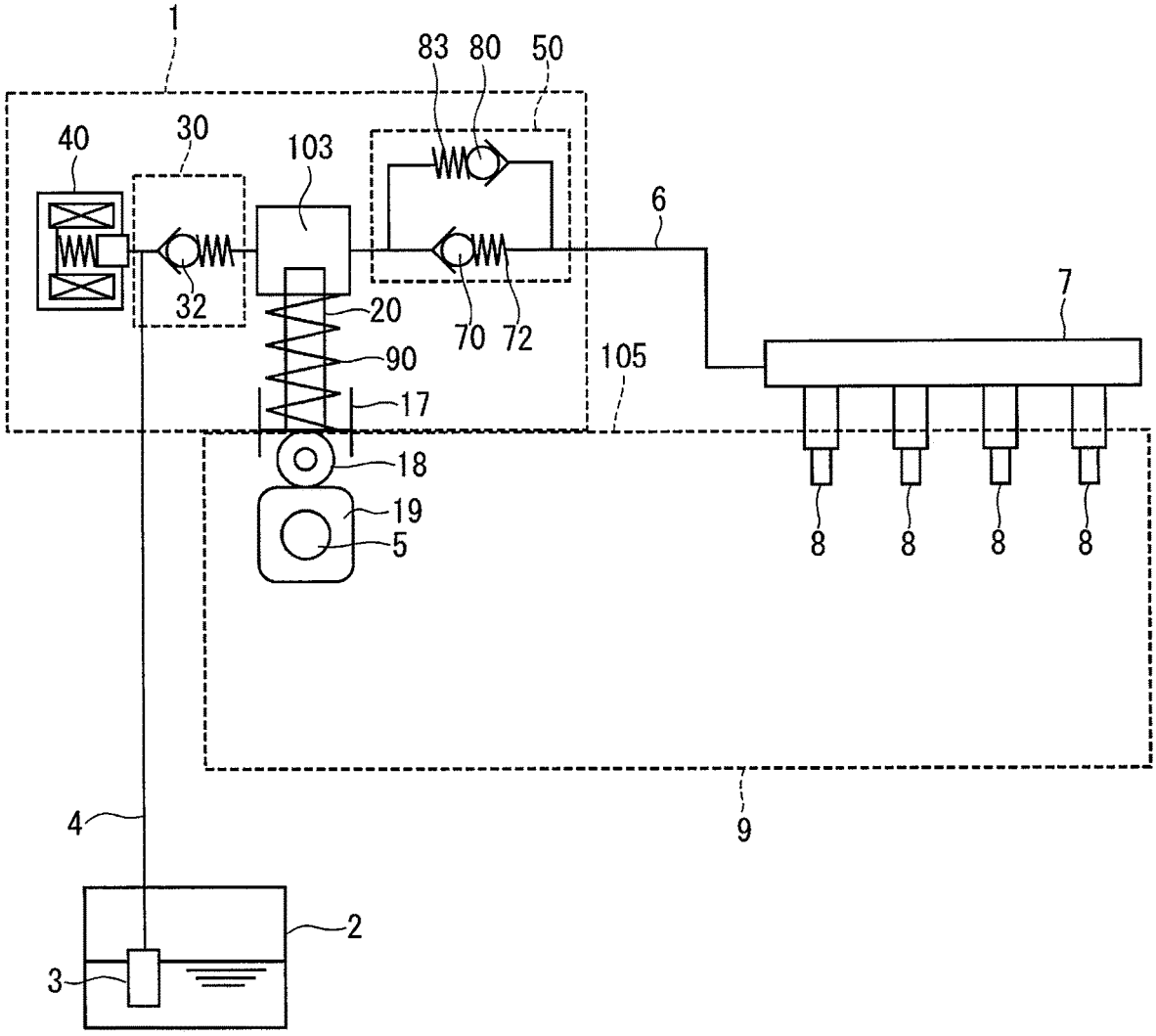
FIG. 1 is a schematic diagram showing a high-pressure pump according to an embodiment of the present disclosure.

As illustrated in FIG. 1, the fuel stored in a fuel tank 2 is supplied to the high-pressure pump 1 through a pipe 4 by a fuel pump 3. The high-pressure pump 1 pressurizes the fuel supplied from the fuel pump 3 and discharges the pressurized fuel to a fuel rail 7 through a pipe 6. As a result, the fuel in the fuel rail 7 is accumulated and injected and supplied to the engine 9 from fuel injection valves 8 connected to the fuel rail 7.

As illustrated in FIG. 2, the high-pressure pump 1 includes a pump body 10, a cover 15, a pulsation damper 16, a plunger 20, a coil spring 90, an intake valve device 30, an electromagnetic drive portion 40, a discharge valve device 50, and the like.

The pump body 10 includes an upper housing 11, a lower housing 12, a cylinder 13, a holder support portion 14, a union 51, and the like.

The upper housing 11 is formed in a substantially rectangular parallelepiped block shape and made of a metal such as stainless steel. The upper housing 11 includes an intake hole portion 111, a discharge hole portion 112, a cylinder hole portion 113, and the like. The intake hole portion 111 opens at one end of the upper housing 11 in a longitudinal direction and is formed in a substantially cylindrical shape so as to extend in the longitudinal direction. As a result, an intake passage 101 is formed inside the intake hole portion 111. The discharge hole portion 112 opens at the other end of the upper housing 11 in the longitudinal direction and is formed in a substantially cylindrical shape so as to extend in the longitudinal direction. As a result, a discharge passage 102 is provided inside the discharge hole portion 112. In this example, the intake hole portion 111 and the discharge hole portion 112 are provided coaxially with each other.

The cylinder hole portion 113 is formed in a substantially cylindrical shape between the intake hole portion 111 and the discharge hole portion 112 so as to open at both end portions of the upper housing 11 in a lateral direction. In this example, a space inside the cylinder hole portion 113 is connected to the intake passage 101 and the discharge passage 102.

The lower housing 12 is formed in a plate shape and made of a metal such as stainless steel. The lower housing 12 includes a cylinder hole portion 124 and a hole portion 125. The cylinder hole portion 124 is formed in a substantially circular shape so as to penetrate through a center of the lower housing 12 in a plate thickness direction. The multiple hole portions 125 are provided on the outside of the cylinder hole portion 124 in the radial direction so as to penetrate in the plate thickness direction.

The lower housing 12 is provided so as to contact against the upper housing 11 so that the cylinder hole portion 113 and the cylinder hole portion 124 are disposed coaxially with each other.

The cylinder 13 is formed in a bottomed cylindrical shape and made of a metal such as stainless steel. The cylinder 13 has a cylinder cylindrical portion 131 which is formed in a cylindrical shape and a cylinder bottom portion 132 which is integrally formed with the cylinder cylindrical portion 131 so as to close one end of the cylinder cylindrical portion 131.

The cylinder cylindrical portion 131 has an intake hole 133 and a discharge hole 134. The intake hole 133 and the discharge hole 134 are provided in the vicinity of the cylinder bottom portion 132 of the cylinder cylindrical portion 131 so as to face each other. In other words, the intake hole 133 and the discharge hole 134 are provided so as to extend in the radial direction of the cylinder cylindrical portion 131 so as to sandwich an axis of the cylinder cylindrical portion 131 between the intake hole 133 and the discharge hole 134. The cylinder 13 is inserted through the cylinder hole portion 113 of the upper housing 11 and the cylinder hole portion 124 of the lower housing 12 so that the intake hole 133 is connected to the intake passage 101 and the discharge hole 134 is connected to the discharge passage 102. An outer wall of an end portion of the cylinder cylindrical portion 131 adjacent to the cylinder bottom portion 132 is fitted to an inner wall forming the cylinder hole portion 113 of the upper housing 11.

The holder support portion 14 is formed in a substantially cylindrical shape and made of a metal such as stainless steel. One end of the holder support portion 14 is provided to connect to an opposite side of the lower housing 12 to the upper housing 11 so that the holder support portion 14 is coaxial with the cylinder 13. In the present embodiment, the holder support portion 14 is formed integrally with the lower housing 12 (refer to FIG. 2).

The union 51 is formed in a substantially cylindrical shape and made of a metal such as stainless steel. The union 51 is provided such that one end of the union 51 is inserted into the discharge hole portion 112 of the upper housing 11. In the present embodiment, the union 51 has threads on the outer wall at one end, and the upper housing 11 has screw grooves on the inner wall of the discharge hole portion 112. The union 51 is fixed to the upper housing 11 by being screwed into the discharge hole portion 112. The union 51 forms the discharge passage 102 on the inner side. The other end of the union 51, that is, an end portion of the union 51 on an opposite side to the upper housing 11 is connected to the end of the pipe 6 on the side opposite to the fuel rail 7.

The cover 15 is made of a metal such as stainless steel. The cover 15 includes a cover cylinder portion 151 and a cover bottom portion 152. The cover cylinder portion 151 is formed in a substantially octagonal cylindrical shape. Therefore, the cover cylinder portion 151 has eight planar outer walls. The cover bottom portion 152 is integrally formed with the cover cylinder portion 151 so as to close one end of the cover cylinder portion 151. The cover 15 is formed in a bottomed cylindrical shape, that is, a cup shape.

The cover 15 accommodates the upper housing 11 inside and is provided so that an end portion of the cover cylinder portion 151 on a side opposite to the cover bottom portion 152, that is, an opening end is connected to the outer edge portion of the lower housing 12. In other words, the lower housing 12 closes the open end of the cover 15. The cover 15 and the lower housing 12 are connected to each other by welding over the entire circumference. As a result, the cover 15 and the lower housing 12 are liquid-tightly kept. A fuel chamber 100 is formed between the inside of the cover 15 and the lower housing 12.

The cover 15 has a hole portion 154 and a hole portion 155. The hole portion 154 and the hole portion 155 are each formed so as to connect an inner wall and an outer wall of the cover cylinder portion 151.

In the present embodiment, the high-pressure pump 1 further includes an inlet pipe not shown. The inlet pipe is formed separately from the cover 15, and one end of the inlet pipe is connected to an outer wall of the cover cylinder portion 151 so that an inner space of the inlet pipe communicates with the fuel chamber 100. A pipe 4 to be connected to the fuel pump 3 is connected to the inlet pipe. As a result, the fuel in the fuel tank 2 flows into the inside of the cover 15, that is, into the fuel chamber 100 through the inlet pipe.

The hole portion 154 and the hole portion 155 are provided at positions corresponding to the intake hole portion 111 and the discharge hole portion 112 of the upper housing 11, respectively. In this example, the union 51 is provided so as to be inserted through the hole portion 155 of the cover 15 and the discharge hole portion 112 of the upper housing 11. The outer wall of the union 51 and the hole portion 155 of the cover 15 are welded together over the entire area in the circumferential direction. As a result, the union 51 and the cover 15 are liquid-tightly kept.

The pulsation damper 16 is provided between the cover bottom portion 152 of the cover 15 and the upper housing 11. The pulsation damper 16 is formed, for example, by joining peripheral portions of two diaphragms together, and gas at a predetermined pressure is sealed inside the pulsation damper 16. A locking member 161 is provided in the vicinity of the cover bottom portion 152 of the cover 15. A damper support portion 162 is provided on the upper housing 11 side of the locking member 161. The damper support portion 162 sandwiches an outer edge portion of the pulsation damper 16 in cooperation with the locking member 161 and is fitted to the locking member 161, to thereby support the pulsation damper 16. The pulsation damper 16 is capable of reducing fuel pressure pulsation with elastic deformation according to a change in the fuel pressure in the fuel chamber 100.

The plunger 20 is formed in a substantially columnar shape and made of a metal such as stainless steel. The plunger 20 includes a large diameter portion 201 and a small diameter portion 202. The small diameter portion 202 has an outer diameter smaller than an outer diameter of the large diameter portion 201. The large diameter portion 201 and the small diameter portion 202 are coaxially integrated together. The plunger 20 is provided such that the large diameter portion 201 is inserted into the inside of the cylinder cylindrical portion 131 of the cylinder 13. The outer diameter of the large diameter portion 201 of the plunger 20 is formed to be substantially equal to an inner diameter of the cylinder cylindrical portion 131 or slightly smaller than the inner diameter of the cylinder cylindrical portion 131. With the above configuration, the plunger 20 is supported such that an outer wall of the large diameter portion 201 slides on an inner wall of the cylinder cylindrical portion 131 and is reciprocally movable by the cylinder cylindrical portion 131.

A pressurizing chamber 103 is provided between inner walls of the cylinder cylindrical portion 131 and the cylinder bottom portion 132 of the cylinder 13 and an outer wall of an end portion of the plunger 20 on the large diameter portion 201. In other words, the plunger 20 is provided such that one end of the plunger 20 can reciprocate inside the cylinder cylindrical portion 131, and the pressurizing chamber 103 for pressurizing the fuel is provided between the outer wall of the one end and the inner wall of the cylinder 13. A volume of the pressurizing chamber 103 changes when the plunger 20 reciprocates inside of the cylinder 13.

In the present embodiment, a seal holder 21 is provided inside the holder support portion 14. The seal holder 21 is formed in a cylindrical shape and made of a metal such as stainless steel. The seal holder 21 is provided so that an outer wall of the seal holder 21 is fitted to an inner wall of the holder support portion 14. The seal holder 21 is provided so as to provide a substantially cylindrical clearance between the inner wall of an end portion of the seal holder 21 opposite to the cylinder 13 and the outer wall of the small diameter portion 202 of the plunger 20. An annular seal 22 is disposed between the inner wall of the seal holder 21 and the outer wall of the small diameter portion 202 of the plunger 20. The seal 22 includes a ring made of a fluororesin on a radially inner side and a ring made of a rubber on a radially outer side. A thickness of a fuel oil film around the small diameter portion 202 of the plunger 20 is adjusted by the seal 22 to prevent the fuel from being leaked into the engine 9. An oil seal 23 is provided at an end portion of the seal holder 21 on a side opposite to the cylinder 13. The thickness of the oil film around the small diameter portion 202 of the plunger 20 is adjusted by the oil seal 23, and leakage of oil is prevented.

A variable volume chamber 104 whose volume changes when the plunger 20 reciprocates is provided between a stepped surface between the large diameter portion 201 and the small diameter portion 202 of the plunger 20 and the seal 22. In this example, the hole portion 125 of the lower housing 12 can communicate the fuel chamber 100 with the variable volume chamber 104. As a result, the fuel in the fuel chamber 100 can move back and forth relative to the variable volume chamber 104 through the hole portion 125.

A substantially disc shaped retainer 24 is provided at an end portion of the small diameter portion 202 of the plunger 20 on the side opposite to the large diameter portion 201.

The coil spring 90 is formed of a wire 91 wound in a coil shape. The wire 91 is made of a metal such as stainless steel. As shown in FIG. 2, the coil spring 90 is provided between the seal holder 21 and the retainer 24 on the radially outer side of the other end of the plunger 20, that is, the end portion on the side of the small diameter portion 202.

An end portion of the coil spring 90 facing the pressurizing chamber 103 in a direction of an axis Ax1 contacts the seal holder 21 and an end portion of the coil spring 90 facing away from the pressurizing chamber 103 contacts the retainer 24. The coil spring 90 can urge the plunger 20 away from the pressurizing chamber 103 through the retainer 24.

The high-pressure pump 1 is fitted to the engine 9 in such a manner that a small diameter portion 202 of the plunger 20, the retainer 24, the coil spring 90, and the holder support portion 14 are inserted into an engine hole portion 106 provided in an engine head 105 of the engine 9 (refer to FIG. 2). In this example, a rubber annular sealing member 141 is disposed between the holder support portion 14 and the engine hole portion 106. As a result, a space between the holder support portion 14 and the engine hole portion 106 is kept liquid-tight or airtight.

In the present embodiment, a bottomed cylindrical tappet 17 is provided inside the engine hole portion 106. The tappet 17 can reciprocate inside the engine hole portion 106 in the axial direction. The other end of the plunger 20, that is, an end portion of the small diameter portion 202 on a side opposite to the large diameter portion 201 contacts a bottom portion of the tappet 17 in a state where the high-pressure pump 1 is installed in the engine 9 (refer to FIG. 2).

A lifter 18 and a cam 19 of a driven shaft 5 are located on an opposite side of the tappet 17 to the plunger 20. At this time, the coil spring 90 can urge the other end of the plunger 20 toward away from the pressurizing chamber 103 and press the other end of the plunger 20 against the tappet 17, that is, toward the cam 19.

The cam 19 rotates together with the driven shaft 5 rotating in conjunction with a driving shaft of the engine 9. The lifter 18 reciprocates in the axial direction of the tappet 17 with the rotation of the cam 19. As a result, when the engine 9 is rotating, the plunger 20 is pushed toward the tappet 17 and urged by the coil spring 90 with the rotation of the cam 19 and the reciprocating movement of the lifter 18, and reciprocates inside the cylinder cylindrical portion 131. At this time, the respective volumes of the pressurizing chamber 103 and the variable volume chamber 104 are periodically changed. The cam 19 has four cam lobes. For that reason, when the cam 19 rotates once, the plunger 20 reciprocates inside the cylinder cylindrical portion 131 four times.

The coil spring 90 will be described in more detail later.

The intake valve device 30 is provided in the intake passage 101 of the upper housing 11. The intake valve device 30 includes an intake valve seat portion 31, an intake valve member 32, a stopper 33, an intake valve urging member 34, and the like.

The intake valve seat portion 31 is formed in a cylindrical shape and made of a metal such as stainless steel. The intake valve seat portion 31 is provided so that an outer wall of the intake valve seat portion 31 is fitted to an inner wall of the upper housing 11 forming the intake hole portion 111. The intake valve seat portion 31 has an intake valve seat 311. The intake valve seat 311 is annularly formed around a hole in the center of a wall surface of the intake valve seat portion 31 facing the pressurizing chamber 103.

The intake valve member 32 is made of a metal such as stainless steel. The intake valve member 32 has, for example, a substantially disc-shaped plate portion. The intake valve member 32 is provided such that a plate portion of the intake valve member 32 can contact the intake valve seat 311 and can reciprocate within the intake passage 101.

The stopper 33 is formed in a bottomed cylindrical shape and made of a metal such as stainless steel. The stopper 33 is provided so that an outer wall of the stopper 33 is fitted to the inner wall of the upper housing 11 forming the intake hole portion 111.

The intake valve urging member 34 is provided between the plate portion of the intake valve member 32 and the bottom portion of the stopper 33. The intake valve urging member 34 urges the intake valve member 32 toward the intake valve seat 311.

In the present embodiment, the fuel passes through a flow channel provided in an outer edge portion of the stopper 33, to thereby enable the fuel to flow between the intake valve seat portion 31 and the pressurizing chamber 103 beyond the stopper 33. In addition, the stopper 33 contacts the intake valve member 32, to thereby enable the movement of the intake valve member 32 toward the pressurizing chamber 103, that is, the movement in a valve opening direction to be restricted. Further, the stopper 33 has a bottom portion between the intake valve member 32 and the pressurizing chamber 103, thereby being capable of preventing the fuel flowing from the pressurizing chamber 103 from colliding with the intake valve member 32.

The electromagnetic drive portion 40 is provided in the vicinity of the intake valve device 30. The electromagnetic drive portion 40 includes a cylinder member 41, a nonmagnetic member 42, a needle 35, a needle guide portion 36, a needle urging member 37, a movable core 43, a fixed core 44, a coil 45, a connector 46, cover members 47 and 48, and so on.

The cylinder member 41 is formed in a substantially cylindrical shape and made of a magnetic material, for example. The cylinder member 41 is provided so as to be inserted through the hole portion 154 of the cover 15 and the intake hole portion 111 of the upper housing 11. An outer wall of one end of the cylinder member 41 is fitted to an inner wall of the intake hole portion 111 of the upper housing 11. In this example, the intake valve seat portion 31 and the stopper 33 are sandwiched between one end of the cylinder member 41 and the inner wall forming the intake hole portion 111 of the upper housing 11. An end portion of the intake valve seat portion 31 on a side opposite to the intake valve seat 311 is located inside one end of the cylinder member 41.

The intake valve seat portion 31 has a hole portion 312 that connects an inner wall and an outer wall of the intake valve seat portion 31. A plurality of the hole portions 312 are provided at regular intervals in a circumferential direction of the intake valve seat portion 31. In the present embodiment, two hole portions 312 are provided. In other words, the two hole portions 312 are provided to face each other across an axis of the intake valve seat portion 31. Further, the cylinder member 41 has a groove portion 411 provided so as to be notched from one end of the cylinder member 41 toward the other end side. Two groove portions 411 are provided in total at positions corresponding to the hole portions 312 of the intake valve seat portion 31 one by one. Further, the upper housing 11 has a hole portion 115 that connects an inner wall and an outer wall forming the intake hole portion 111. Two hole portions 115 are provided in total at positions corresponding to the groove portions 411 of the cylinder member 41 one by one. The fuel in the fuel chamber 100 can flow into the inside of the intake valve seat portion 31 through the hole portion 115, the groove portion 411, and the hole portion 312. The fuel that has flowed into the inside of the intake valve seat portion 31 can flow toward the pressurizing chamber 103 after passing between the intake valve seat 311 and the intake valve member 32 and through the flow channel of the stopper 33.

Further, the outer wall of the cylinder member 41 and the hole portion 154 of the cover 15 are welded over an entire area in the circumferential direction. As a result, the cylinder member 41 and the cover 15 are liquid-tightly kept.

The nonmagnetic member 42 is formed in a cylindrical shape and made of a nonmagnetic material. The nonmagnetic member 42 is provided on the side of the cylinder member 41 opposite to the upper housing 11 so as to be coaxial with the cylinder member 41.

The needle 35 is formed in a rod shape and made of, for example, a metal. The needle 35 is provided so as to reciprocate in the axial direction inside the cylinder member 41. One end of the needle 35 can contact the intake valve member 32.

The needle guide portion 36 is provided so that an outer wall of the needle guide portion 36 is fitted to an inner wall of the cylinder member 41. The needle guide portion 36 has a guide hole portion 361 in the center. The guide hole portion 361 is formed to connect a wall surface of the needle guide portion 36 adjacent to the pressurizing chamber 103 to a wall surface of the needle guide portion 36 on the opposite side to the pressurizing chamber 103. The needle 35 is inserted through the guide hole portion 361. An inner diameter of the guide hole portion 361 is substantially equal to an outer diameter of the needle 35 or slightly larger than the outer diameter of the needle 35. The inner wall of the guide hole portion 361 and the outer wall of the needle 35 are slidable on each other. As a result, the needle guide portion 36 can guide movement of the needle 35 in the axial direction.

The needle urging member 37 is formed of, for example, a coil spring, and is provided on the pressurizing chamber 103 side of the needle guide portion 36. One end of the needle urging member 37 contacts a protrusion portion annularly protruding from the needle 35 toward a radially outer side, and the other end of the needle urging member 37 is provided so as to contact the needle guide portion 36. The needle urging member 37 urges the needle 35 toward the pressurizing chamber 103 side. Therefore, the needle urging member 37 can urge the intake valve member 32 toward the stopper 33 through the needle 35.

The movable core 43 is formed in a substantially cylindrical shape and made of a magnetic material and press-fitted into the other end of the needle 35. As a result, the movable core 43 can reciprocate in the axial direction together with the needle 35.

The fixed core 44 is formed in a solid cylindrical shape and made of a magnetic material and is provided on the side of the movable core 43 opposite to the pressurizing chamber 103. An end portion of the fixed core 44 on the pressurizing chamber 103 side is connected to the nonmagnetic member 42.

The coil 45 is formed in a substantially cylindrical shape and is provided on the radially outer side of the fixed core 44 and the nonmagnetic member 42. The periphery of the coil 45 is molded with a resin material to form the connector 46. The connector 46 is insert-molded with a terminal 461. The terminal 461 and the coil 45 are electrically connected to each other.

The cover members 47 and 48 are made of a magnetic material. The cover member 47 is formed in a bottomed cylindrical shape, and accommodates the fixed core 44 and the coil 45 on an inner side of the cover member 47, and a bottom portion of the cover member 47 contacts the fixed core 44. The cover member 48 is formed in a plate shape and has a hole in the center. The cover member 48 is provided so as to close an opening end of the cover member 47 in a state in which the other end of the cylinder member 41 is inserted through the hole. In this example, the cover member 48 contacts the cover member 47 and the cylinder member 41.

The coil 45 generates a magnetic field by being supplied with electric power from the outside through the terminal 461. When a magnetic field is generated in the coil 45, a magnetic circuit is formed in the fixed core 44, the cover member 47, the cover member 48, the cylinder member 41, and the movable core 43, and the movable core 43 is attracted to the fixed core 44 side together with the needle 35. At this time, the magnetic circuit is formed so as to avoid the nonmagnetic member 42.

When no electric power is supplied to the coil 45, the intake valve member 32 is urged toward the pressurizing chamber 103 side by an urging force of the needle urging member 37 through the needle 35, and a surface of the intake valve member 32 on the stopper 33 side contacts the stopper 33. At this time, since the intake valve member 32 is separated from the intake valve seat 311, the flow of fuel in the intake passage 101 and the intake hole 133 is permitted. On the other hand, when an electric power is supplied to the coil 45 to attract the movable core 43 and the needle 35 to the fixed core 44 side, the intake valve member 32 is urged by the urging force of the intake valve urging member 34 or the like to move to the side opposite from the pressurizing chamber 103, and contacts the intake valve seat 311. As a result, the fuel flow in the intake passage 101 and the intake hole 133 is blocked.

In the manner described above, the intake valve device 30 can allow or interrupt the flow of fuel in the intake passage 101 and the intake hole 133 by the operation of the electromagnetic drive portion 40. In the present embodiment, the intake valve device 30 forms a so-called normally open type valve device together with the electromagnetic drive portion 40.

As shown in FIG. 2, the discharge valve device 50 includes a valve seat portion 60, a discharge valve member 70, a spring holder 71, a spring 72, a relief valve member 80, a spring holder 82, a spring 83, and the like.

The valve seat portion 60 is made of a metal such as stainless steel, and is provided inside the union 51.

The valve seat portion 60 includes a discharge valve passage 61, a relief valve passage 62, a discharge valve seat 63, a relief valve seat 64, and so on.

The discharge valve passage 61 is provided so as to connect the pressurizing chamber 103 side of the valve seat portion 60 and an opposite side to the pressurizing chamber 103. The relief valve passage 62 is provided in the valve seat portion 60 so as to connect the pressurizing chamber 103 side of the valve seat portion 60 and the opposite side to the pressurizing chamber 103 and so as not to communicate with the discharge valve passage 61.

The discharge valve seat 63 is annularly formed around an opening of the discharge valve passage 61 of the valve seat portion 60 on a side opposite to the pressurizing chamber 103. The relief valve seat 64 is annularly formed around an opening of the relief valve passage 62 of the valve seat portion 60 on the pressurizing chamber 103 side. In this example, the relief valve seat 64 is tapered so as to approach an axis of the relief valve seat 64 from the pressurizing chamber 103 side toward the opposite side to the pressurizing chamber 103.

The discharge valve member 70 is formed in a substantially disk shape and made of a metal such as stainless steel. The discharge valve member 70 can reciprocate in the discharge passage 102 so as to be able to contact the discharge valve seat 63, and separates from the discharge valve seat 63 or contacts the discharge valve seat 63 to open or close the discharge valve passage 61.

The spring holder 71 is formed in a bottomed cylindrical shape, made of a metal such as stainless steel, and is disposed inside of the union 51. The spring holder 71 is provided such that an inner wall of an end portion of the spring holder 71 on a side opposite to the bottom portion is fitted to an outer wall of an end portion of the valve seat portion 60 on the discharge valve seat 63 side. As a result, the spring holder 71 cannot move relative to the valve seat portion 60. The spring holder 71 has multiple holes for connecting the inner wall and the outer wall of the spring holder 71.

The spring 72 is, for example, a coil spring, and is provided on a side of the discharge valve member 70 opposite to the valve seat portion 60. The spring 72 is disposed inside of the spring holder 71 such that one end of the spring 72 contacts the discharge valve member 70 and the other end contacts the bottom portion of the spring holder 71. The spring 72 urges the discharge valve member 70 toward the discharge valve seat 63 side. As a result, the discharge valve member 70 is pressed against the discharge valve seat 63. The discharge valve member 70 is provided so as to reciprocate inside the spring holder 71 in the axial direction.

The relief valve member 80 is made of a metal such as stainless steel, and formed in a spherical shape. The relief valve member 80 can reciprocate in the discharge passage 102 so as to be able to contact the relief valve seat 64, and separates from the relief valve seat 64 or contacts the relief valve seat 64 to open or close the relief valve passage 62.

A valve member holder 81 is disposed on the pressurizing chamber 103 side of the relief valve member 80. The valve member holder 81 is formed annularly and made of a metal such as stainless steel. The valve member holder 81 contacts the pressurizing chamber 103 side of the relief valve member 80 and can reciprocate in the discharge passage 102 together with the relief valve member 80.

The spring holder 82 is formed in a bottomed cylindrical shape, made of a metal such as stainless steel, and is disposed inside of the union 51 and the valve seat portion 60. The spring holder 82 is provided such that an outer wall of an end portion of the spring holder 82 on a side opposite to the bottom portion is fitted to an inner wall of an end portion of the valve seat portion 60 on the pressurizing chamber 103 side. As a result, the spring holder 82 cannot move relative to the valve seat portion 60. The spring holder 82 has multiple holes for connecting the inner wall and the outer wall of the spring holder 82.

The spring 83 is, for example, a coil spring, and is provided on a side of the valve member holder 81 opposite to the relief valve member 80. The spring 83 is disposed inside of the spring holder 82 such that one end of the spring 83 contacts the valve member holder 81 and the other end contacts the bottom portion of the spring holder 82. The spring 83 urges the relief valve member 80 toward the relief valve seat 64 side through the valve member holder 81. As a result, the relief valve member 80 is pressed against the relief valve seat 64. The relief valve member 80 is provided so as to be able to reciprocate inside the spring holder 82.

When a pressure of the fuel in a space of the discharge passage 102 on the pressurizing chamber 103 side of the valve seat portion 60 becomes higher than a total of a pressure of the fuel in a space on an opposite side to pressurizing chamber 103 and an urging force of the spring 72 (a valve opening pressure of the discharge valve member 70), the discharge valve member 70 is separated from the discharge valve seat 63 and opened. As a result, the fuel on the pressurizing chamber 103 side is discharged toward the pipe 6 side through the discharge valve passage 61 and the discharge valve seat 63. The valve opening pressure of the discharge valve member 70 can be set by adjusting the urging force of the spring 72.

On the other hand, when a pressure of the fuel in the space of the discharge passage 102 on the side opposite of the valve seat portion 60 to the pressurizing chamber 103 becomes higher than a total of a pressure of the fuel in the space on the pressurizing chamber 103 and the urging force of the spring 83 (a valve opening pressure of the relief valve member 80), the relief valve member 80 is separated from the relief valve seat 64 and opened. As a result, the fuel on the pipe 6 side is returned to the pressurizing chamber 103 side through the relief valve passage 62 and the relief valve seat 64. As a result, the pressure of the fuel in the space of the discharge passage 102 on the side of the valve seat portion 60 opposite to the pressurizing chamber 103 can be prevented from increasing abnormally. The valve opening pressure of the relief valve member 80 can be set by adjusting the urging force of the spring 83.

As described above, the discharge valve device 50 according to the present embodiment is a relief valve integrated discharge valve device having both of a function as the discharge valve and a function as the relief valve.

Next, the coil spring 90 will be described in more detail.

Figure 3:
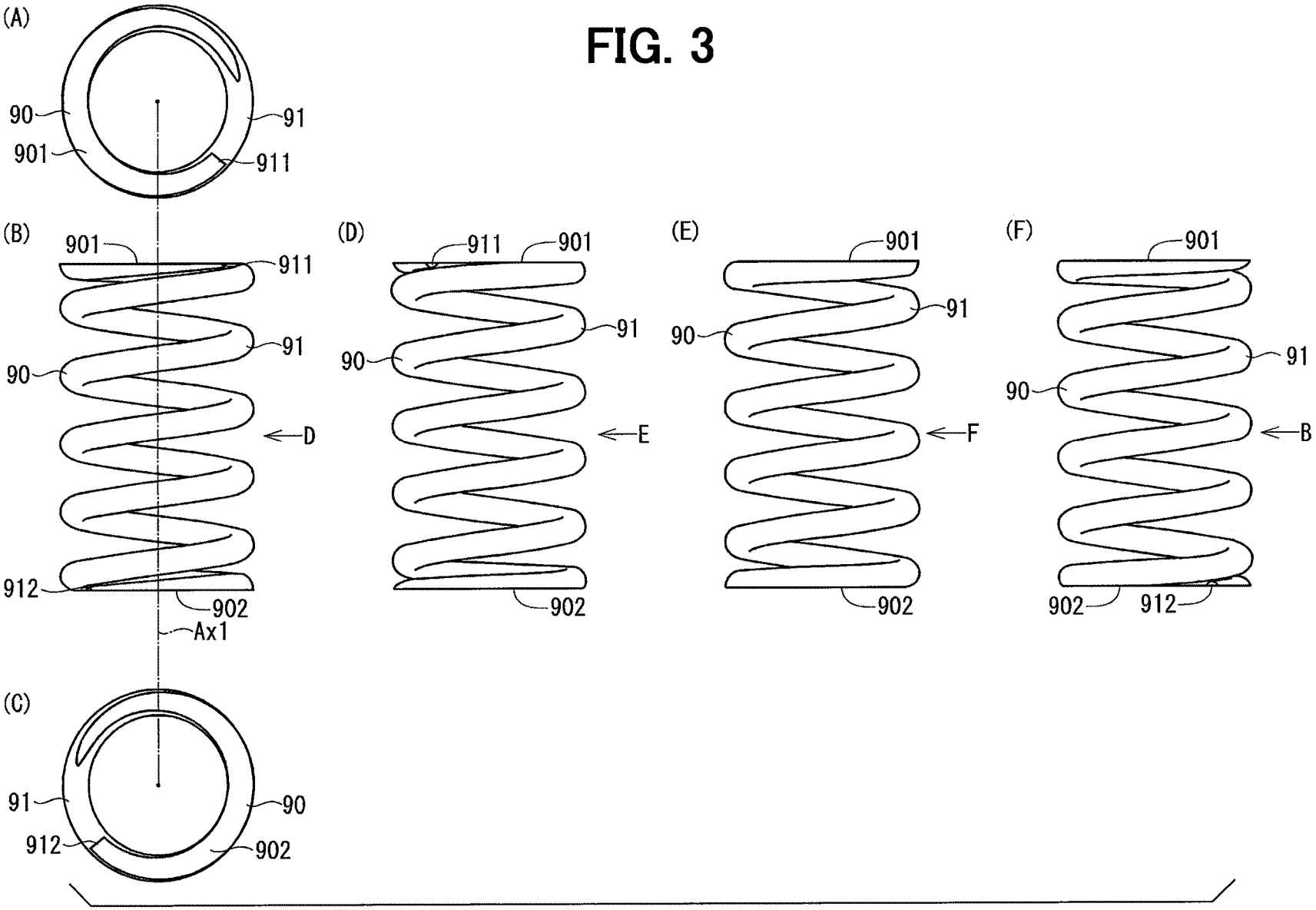
FIG. 3 illustrates views showing a state in which a coil spring of the high-pressure pump is of a free length according to the embodiment, (A) is a top view of the coil spring, (B) is a front view of the coil spring, (C) is a view of a bottom surface of the coil spring when viewed from a top surface, (D) is a view when (B) is viewed from a direction of an arrow D, (E) is a view when (D) is viewed from a direction of an arrow E, and (F) is a view when (E) is viewed from a direction of an arrow F.

As shown in FIG. 3, the coil spring 90 is formed of the wire 91. In the present embodiment, the coil spring 90 is formed by winding the wire 91 in a coil shape, for example, by about 6.3 turns. The coil spring 90 has a planar end face 901 at one end in the direction of the axis Ax1 and a planar end face 902 at the other end. The end face 901 is an end face of the coil spring 90 facing the pressurizing chamber 103 in the direction of the axis Ax1 and contacts the seal holder 21.

The end face 902 is an end face of the coil spring 90 facing the cam 19 in the direction of the axis Ax1 and contacts the retainer 24.

As shown in FIGS. 3(B) and 3(D), the wire 91 is formed so that an end portion 911 of the wire 91 facing the pressurizing chamber 103 contacts an adjacent portion of the wire 91 of the coil spring 90 in the direction of the axis Ax1 in a free length. As shown in FIGS. 3(B) and 3(F), the wire 91 is formed so that an end portion 912 of the wire 91 facing the cam 19 contacts an adjacent portion of the wire 91 of the coil spring 90 in the direction of the axis Ax1 in a free length.

Figure 4:
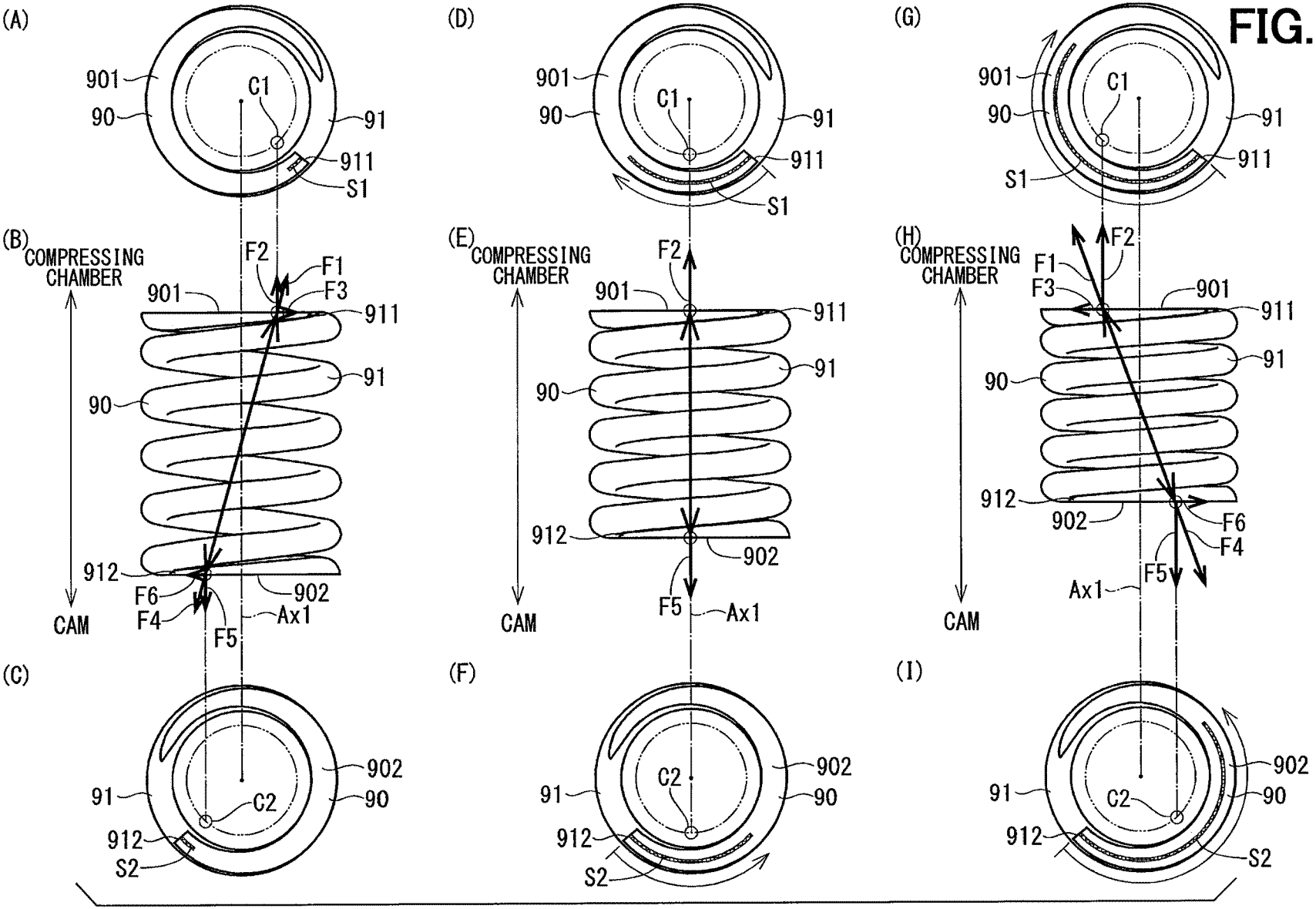
FIG. 4 illustrates diagrams showing the coil spring of the high-pressure pump according to the embodiment, (A) is a top view of the coil spring when the plunger is located at a bottom dead center, (B) is a front view of the coil spring when the plunger is located at the bottom dead center, (C) is a view of a bottom surface of the coil spring when viewed from a top surface when the plunger is positioned at the bottom dead center, (D) is a top view of the coil spring when the plunger is located at an intermediate position between the bottom dead center and a top dead center, (E) is a front view of the coil spring when the plunger is located at the intermediate position between the bottom dead center and the top dead center, (F) is a diagram of the bottom surface of the coil spring when viewed from the top surface side when the plunger is located at the intermediate position between the bottom dead center and the top dead center, (G) is a top view of the coil spring when the plunger is located at the top dead center, (H) is a front view of the coil spring when the plunger is located at the top dead center, and (I) is a view of the bottom surface of the coil spring when viewed from the top surface side when the plunger is located at the top dead center.

FIGS. 4(A), 4(B) and 4(C) show a state of the coil spring 90 when the high-pressure pump 1 is attached to the engine 9 and the plunger 20 is located at the bottom dead center (refer to FIG. 2). In other words, the coil spring 90 shown in FIGS. 4(A), 4(B) and 4(C) is compressed in the direction of the axis Ax1 from the free length, and the spring length is shorter than the free length.

In this example, a center of load in a virtual plane including the end face 901 of the coil spring 90 facing the pressurizing chamber 103 in the direction of the axis Ax1 is defined as an upper load center C1 (refer to FIG. 4(A)), and a center of load in an virtual plane including the end face 902 of the coil spring 90 facing the cam 19 in the direction of the axis Ax1 is defined as a lower load center C2 (refer to FIG. 4(C)). When the coil spring 90 is viewed from the direction of the axis Ax1 (refer to FIGS. 4(A) and 4(C)), the upper load center C1 and the lower load center C2 do not coincide with each other.

At this time, a load F1 in a direction inclined with respect to the end face 901 acts on the seal holder 21 from the end face 901 of the coil spring 90. In other words, a vertical load F2, which is a load in a direction perpendicular to the end face 901, and a horizontal load F3, which is a load in a direction horizontal to the end face 901, act on the seal holder 21 from the end face 901 of the coil spring 90 (refer to FIG. 4(B)).

In addition, at this time, a load F4 in a direction inclined with respect to the end face 902 acts on the retainer 24 from the end face 902 of the coil spring 90. In other words, a vertical load F5, which is a load in a direction perpendicular to the end face 902, and a horizontal load F6, which is a load in a direction horizontal to the end face 902, act on the retainer 24 from the end face 902 of the coil spring 90 (refer to FIG. 4(B)).

In addition, a circumferential range of the wire 91 in which the end portion 911 of the wire 91 facing the pressurizing chamber 103 is in close contact with an adjacent portion of the wire 91 in the direction of the axis Ax1 of the coil spring 90 and the wire gap therebetween is zero is defined as an upper close contact range S1 (refer to FIG. 4(A)), and a circumferential range of the wire 91 in which the end portion 912 of the wire 91 facing the cam 19 is in close contact with an adjacent portion of the wire 91 in the direction of the axis Ax1 of the coil spring 90 and the wire gap therebetween is zero is defined as a lower close contact range S2 (refer to FIG. 4(C)). The upper load center C1 is located on a virtual straight line connecting the axis Ax1 and the center of the upper close contact range S1 (refer to FIG. 4(A)). Further, the lower load center C2 is located on a virtual straight line connecting the axis Ax1 and the center of the lower close contact range S2 (refer to FIG. 4(C)).

FIGS. 4(D), 4(E) and 4(F) show a state of the coil spring 90 when the plunger 20 is located at a substantially intermediate position between the bottom dead center and the top dead center. In other words, the coil spring 90 shown in FIGS. 4(D), 4(E) and 4(F) is further compressed in the direction of the axis Ax1 from a state shown in FIGS. 4(A), 4(B), and 4(C), and the spring length is further shorter.

In this example, when the coil spring 90 is viewed from the direction of the axis Ax1 (refer to FIGS. 4(D) and 4(F)), the upper load center C1 moves in one direction from a position shown in FIG. 4(A) along a circumference of the coil spring 90. The lower load center C2 moves from a position shown in FIG. 4(C) in an opposite direction along the circumference of the coil spring 90 and coincides with the upper load center C1. In other words, at this time, the upper load center C1 and the lower load center C2 coincide with each other.

At this time, only the vertical load F2, which is a load in a direction perpendicular to the end face 901, acts on the seal holder 21 from the end face 901 of the coil spring 90 (refer to FIG. 4(E)). The vertical load F2 at this time is larger than the vertical load F2 shown in FIG. 4(B).

At this time, only the vertical load F5, which is a load in a direction perpendicular to the end face 902, acts on the retainer 24 from the end face 902 of the coil spring 90 (refer to FIG. 4(E)). The vertical load F5 at this time is larger than the vertical load F5 shown in FIG. 4(B).

Further, the upper load center C1 is located on a virtual straight line connecting the axis Ax1 and the center of the upper close contact range S1 (refer to FIG. 4(D)). The upper close contact range S1 at this time expands in the one direction along the circumference of the coil spring 90 as compared with the upper close contact range S1 shown in FIG. 4(A).

Further, the lower load center C2 is located on a virtual straight line connecting the axis Ax1 and the center of the lower close contact range S2 (refer to FIG. 4(F)). The lower close contact range S2 at this time expands in the opposite direction along the circumference of the coil spring 90 as compared with the lower close contact range S2 shown in FIG. 4(C).

FIGS. 4(G), 4(H) and 4(I) show a state of the coil spring 90 when the plunger 20 is located at the top dead center. In other words, the coil spring 90 shown in FIGS. 4(G), 4(H) and 4(I) is further compressed in the direction of the axis Ax1 from a state shown in FIGS. 4(D), 4(E), and 4(F), and the spring length is further shorter.

In this example, when the coil spring 90 is viewed from the direction of the axis Ax1 (refer to FIGS. 4(G) and 4(I)), the upper load center C1 moves in the one direction from a position shown in FIG. 4(D) along a circumference of the coil spring 90. The lower load center C2 moves from a position shown in FIG. 4(F) in the opposite direction along the circumference of the coil spring 90. In other words, at this time, the upper load center C1 and the lower load center C2 do not coincide with each other.

At this time, a load F1 in a direction inclined with respect to the end face 901 acts on the seal holder 21 from the end face 901 of the coil spring 90. In other words, a vertical load F2, which is a load in a direction perpendicular to the end face 901, and a horizontal load F3, which is a load in a direction horizontal to the end face 901, act on the seal holder 21 from the end face 901 of the coil spring 90 (refer to FIG. 4(H)). The vertical load F2 at this time is larger than the vertical load F2 shown in FIG. 4(E). The horizontal load F3 at this time is in a direction opposite to the horizontal load F3 shown in FIG. 4(B).

In addition, at this time, a load F4 in a direction inclined with respect to the end face 902 acts on the retainer 24 from the end face 902 of the coil spring 90. In other words, a vertical load F5, which is a load in a direction perpendicular to the end face 902, and a horizontal load F6, which is a load in a direction horizontal to the end face 902, act on the retainer 24 from the end face 902 of the coil spring 90 (refer to FIG. 4(H)). The vertical load F5 at this time is larger than the vertical load F5 shown in FIG. 4(E). The horizontal load F6 at this time is in a direction opposite to the horizontal load F6 shown in FIG. 4(B).

Further, the upper load center C1 is located on a virtual straight line connecting the axis Ax1 and the center of the upper close contact range S1 (refer to FIG. 4(G)). The upper close contact range S1 at this time expands in the one direction along the circumference of the coil spring 90 as compared with the upper adhesion range S1 shown in FIG. 4(D).

Further, the lower load center C2 is located on a virtual straight line connecting the axis Ax1 and the center of the lower close contact range S2 (refer to FIG. 4(I)). The lower close contact range S2 at this time expands in the opposite direction along the circumference of the coil spring 90 as compared with the lower close contact range S2 shown in FIG. 4(F).

As shown in FIGS. 4(A) to 4(I), in the coil spring 90, as viewed from the direction of the axis Ax1 (refer to FIGS. 4(A), 4(C), 4(D), 4(F), 4(G), and 4(I)), when the plunger 20 moves toward the pressurizing chamber 103 by rotation of the cam 19, the upper load center C1 moves in the one direction along the circumference of the coil spring 90, the lower load center C2 moves in the opposite direction along the circumference of the coil spring 90, and coincides with the upper load center C1 (refer to FIGS. 4(D) and 4(F)) and subsequently further moves in the opposite direction.

With the configuration described above, when the plunger 20 is located at the bottom dead center, a radial force (hereinafter referred to as "lateral force") Fs1 acts on an end portion of the large diameter portion 201 of the plunger 20 facing the small diameter portion 202. In addition, a lateral force Fs2, which is smaller than the lateral force Fs1 and is opposite to the lateral force Fs1, acts on the end portion of the large diameter portion 201 facing the pressurizing chamber 103. For that reason, in the plunger 20, the axis Ax2 is inclined with respect to the axis of the cylinder cylindrical portion 131, and the end portion of the large diameter portion 201 facing the small diameter portion 202 and the end portion of the large diameter portion 201 facing the pressurizing chamber 103 are pressed against the inner wall of the cylinder cylindrical portion 131 (refer to FIG. 5A). In this example, the end portion of the large diameter portion 201 facing the small diameter portion 202 is strongly pressed against the inner wall of the cylinder cylindrical portion 131, compared with the end portion of the large diameter portion 201 facing the pressurizing chamber 103.

When the plunger 20 moves from the bottom dead center toward the top dead center by the rotation of the cam 19 and is located at a substantially intermediate position between the bottom dead center and the top dead center, the lateral force Fs1 acting on the end portion of the large diameter portion 201 of the plunger 20 facing the small diameter portion 202 and the lateral force acting on the end portion of the large diameter portion 201 facing the pressurizing chamber 103 become substantially zero. For that reason, the plunger 20 is substantially coaxial with the cylinder cylindrical portion 131 (refer to FIG. 5B).

Figure 5A:
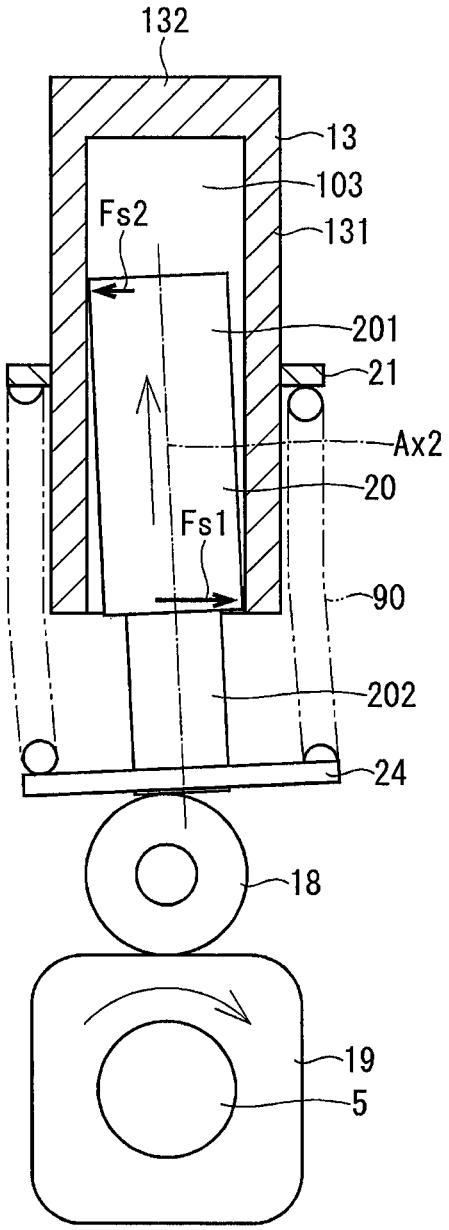
FIG. 5A is a schematic diagram showing the plunger and its neighborhood when the plunger of the high-pressure pump is located at the bottom dead center according to the embodiment.
Figure 5B:
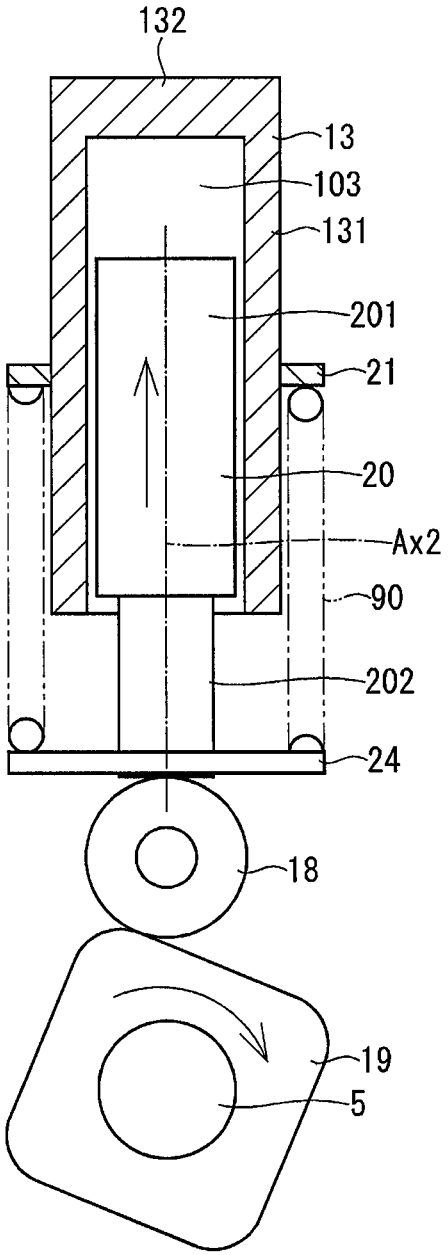
FIG. 5B is a schematic diagram showing the plunger and its neighborhood of the plunger when the plunger of the high-pressure pump is located at the intermediate position between the bottom dead center and the top dead center according to the embodiment.
Figure 5C:
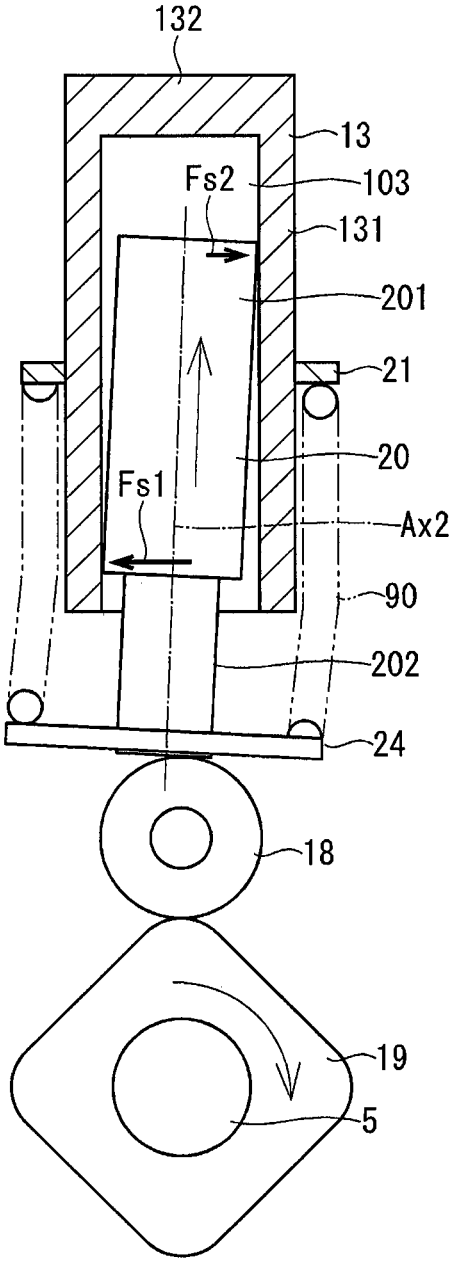
FIG. 5C is a schematic diagram showing the plunger and its neighborhood of the plunger when the plunger of the high-pressure pump is located at the top dead center according to the embodiment.

When the plunger 20 further moves toward the top dead center by the further rotation of the cam 19 and is located at the top dead center, the lateral force Fs1 in a direction opposite to that of the force Fs1 shown in FIG. 5A acts on the end portion of the large diameter portion 201 of the plunger 20 facing the small diameter portion 202. Further, the lateral force Fs2 in a direction opposite to that of the lateral force Fs2 shown in FIG. 5A acts on the end portion of the large diameter portion 201 facing the pressurizing chamber 103. For that reason, in the plunger 20, the axis Ax2 is inclined with respect to the axis of the cylinder cylindrical portion 131, and the end portion of the large diameter portion 201 facing the small diameter portion 202 and the end portion of the large diameter portion 201 facing the pressurizing chamber 103 are pressed against the inner wall of the cylinder cylindrical portion 131 (refer to FIG. 5C).

Next, comparing the present embodiment with the comparative example, the advantageous features of the present embodiment to the comparative example will be clarified.

In the comparative example, only the configuration of the coil spring 90 is different from that of the present embodiment. The coil spring 90 in the comparative example is formed by winding the wire 91 in a coil shape by about 5.8 turns.

Figure 6A:
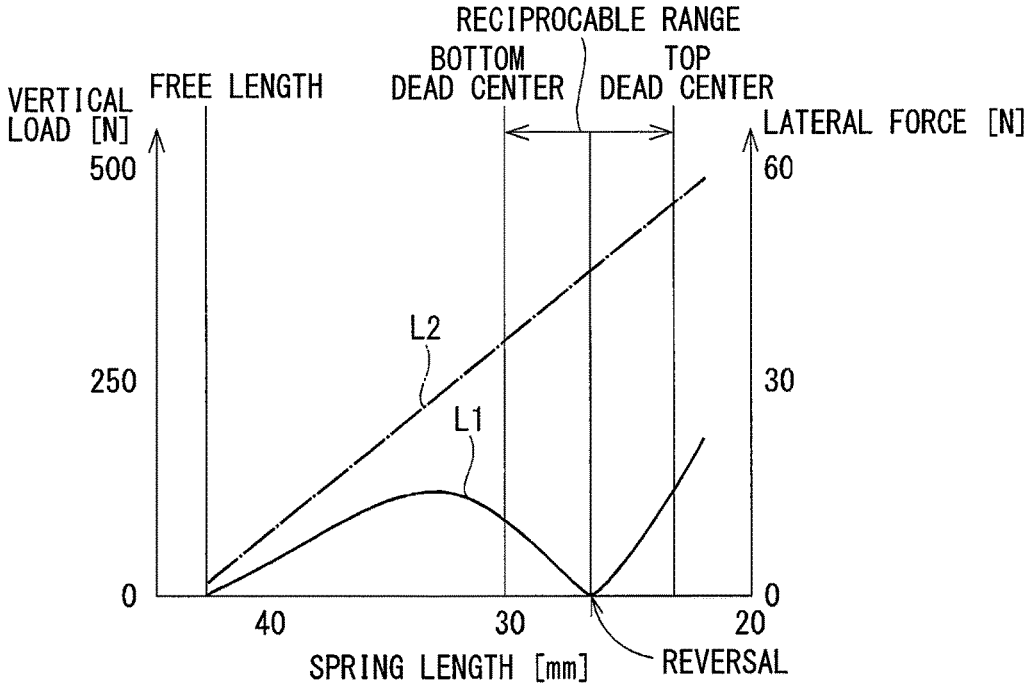
FIG. 6A is a diagram showing a relationship between a length of the coil spring of the high-pressure pump when the coil spring is compressed, a lateral force acting on the plunger, and a vertical load acting on an end portion of the plunger adjacent to a cam according to the embodiment.

A relationship between a length of the compressed coil spring 90 and the lateral force acting on the plunger 20 according to the present embodiment is indicated by a solid line L1 in FIG. 6A, and a relationship between the length of the compressed coil spring 90 and the vertical load acting on the end portion (the retainer 24) of the plunger 20 facing the cam 19 according to the present embodiment is indicated by a one-dot chain line L2 in FIG. 6A.

Figure 6B:
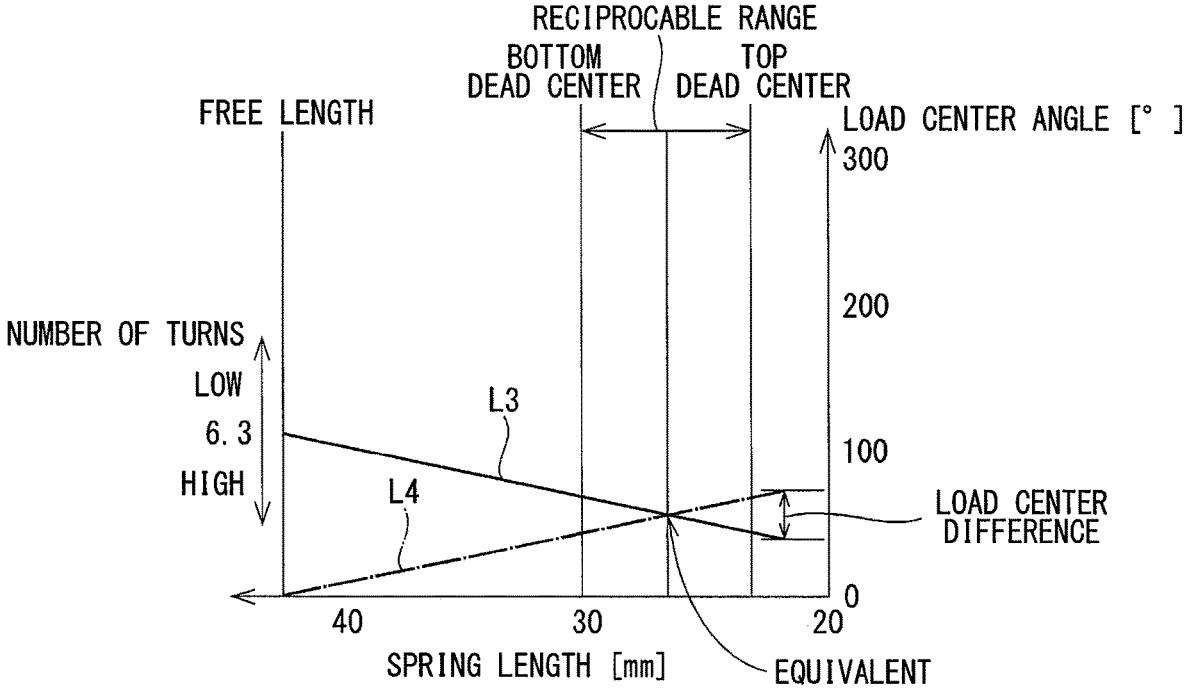
FIG. 6B is a diagram showing a relationship between the length of the coil spring of the high-pressure pump when the coil spring is compressed, an angle of an upper load center relative to a reference angular position, and an angle of a lower load center relative to the reference angular position according to the embodiment.

Further, a relationship between the length of the compressed coil spring 90 and an angle of the upper load center C1 relative to a reference angular position (the angular position of the lower load center C2 when the coil spring 90 is of a free length) according to the present embodiment is indicated by a solid line L3 in FIG. 6B, and a relationship between the length of the compressed coil spring 90 and an angle of the lower load center C2 relative to the reference angular position according to the present embodiment is indicated by a one-dot chain line L4 in FIG. 6B.

In FIG. 6B, a difference between the angle of the upper load center C1 and the angle of the lower load center C2 with respect to the reference angular position corresponds to the amount of deviation (load center difference) between the upper load center C1 and the lower load center C2.

Figure 7A:
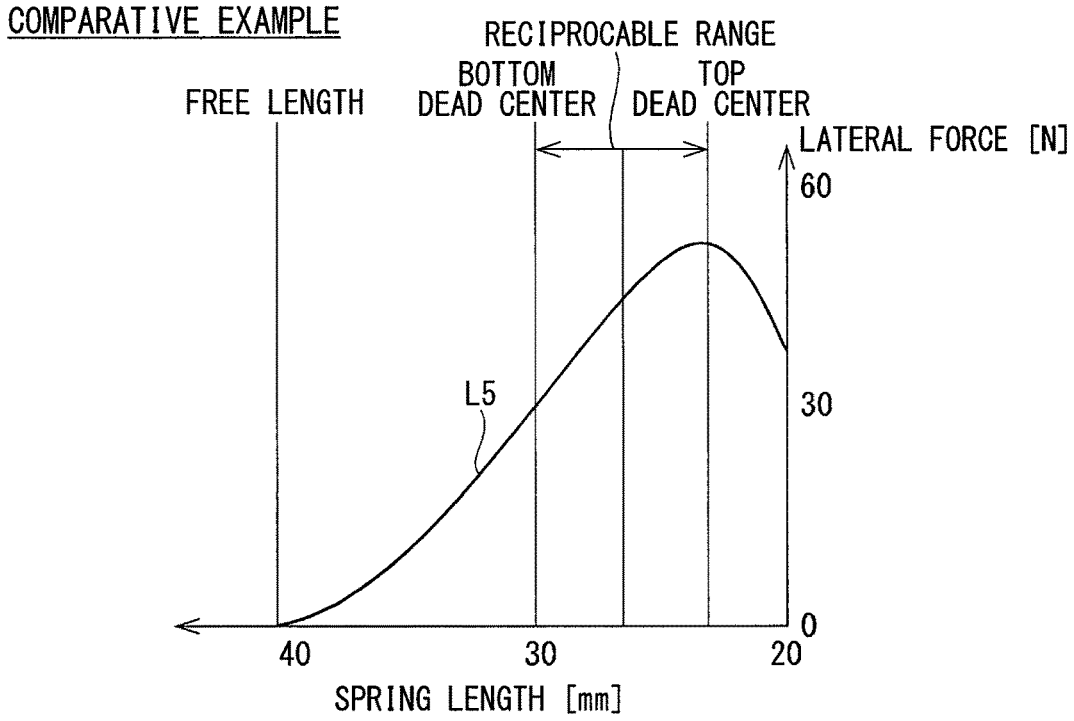
FIG. 7A is a diagram showing a relationship between a length of a coil spring of a high-pressure pump when the coil spring is compressed and a lateral force acting on the plunger according to a comparative example of the present disclosure.

A relationship between a length of the compressed coil spring 90 and a lateral force (Fs1) acting on the end portion of the large diameter portion 201 of the plunger 20 facing the small diameter portion 202 according to the comparative example is indicated by a solid line L5 in FIG. 7A.

Figure 7B:
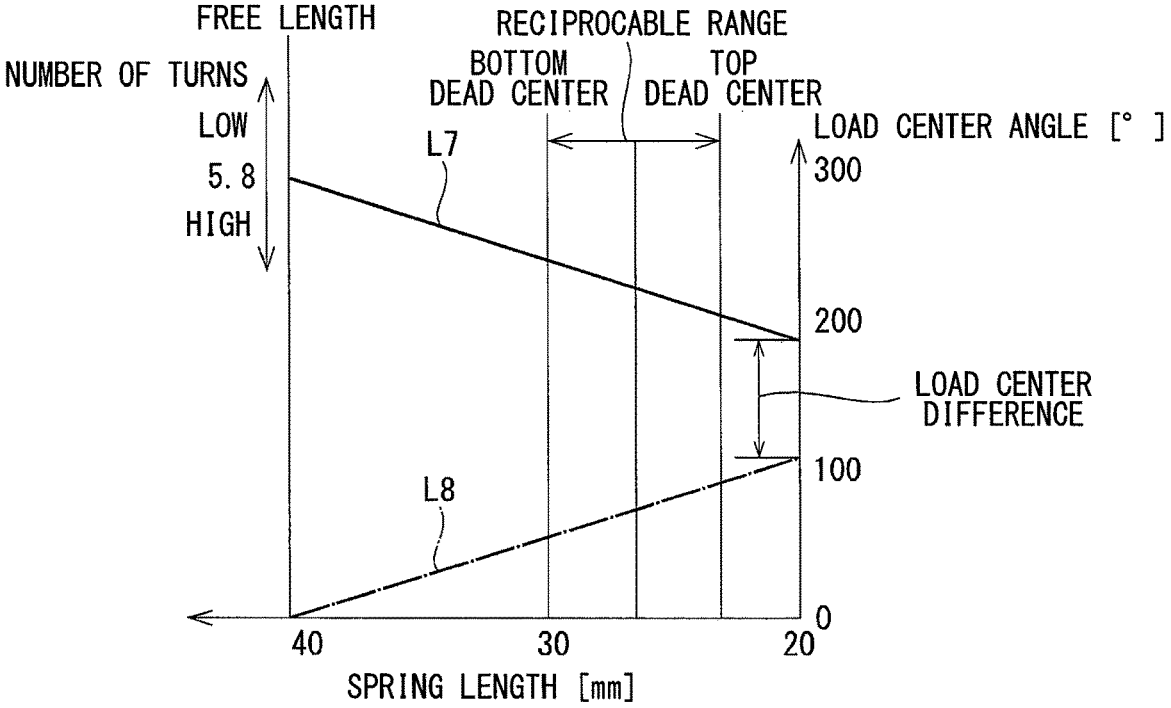
FIG. 7B is a diagram showing a relationship between the length of the coil spring of the high-pressure pump when the coil spring is compressed, an angle of an upper load center relative to a reference angular position, and an angle of a lower load center relative to the reference angular position according to the comparative example.

Further, a relationship between the length of the compressed coil spring 90 and an angle of the upper load center C1 relative to a reference angular position according to the comparative example is indicated by a solid line L7 in FIG. 7B, and a relationship between the length of the compressed coil spring 90 and an angle of the lower load center C2 relative to the reference angular position according to the comparative example is indicated by a one-dot chain line L8 in FIG. 7B.

In FIG. 7B, a difference between the angle of the upper load center C1 and the angle of the lower load center C2 with respect to the reference angular position corresponds to the amount of deviation (load center difference) between the upper load center C1 and the lower load center C2.

As shown in FIG. 6B, in the present embodiment, when the plunger 20 moves from the bottom dead center toward the top dead center and the coil spring 90 is compressed, the upper load center C1 and the lower load center C2 coincide with each other. At this time, as shown in FIG. 6A, the lateral force acting on the end portion of the large diameter portion 201 of the plunger 20 facing the small diameter portion 202 becomes zero and then reverses. For that reason, the plunger 20 moves toward the pressurizing chamber 103 while tilting the axis Ax2. Also, when the plunger 20 moves from the top dead center toward the bottom dead center and the coil spring 90 expands, the upper load center C1 and the lower load center C2 coincide with each other. Hence, in the present embodiment, the plunger 20 swings so that the axis Ax2 is tilted when the plunger reciprocates inside of the cylinder cylindrical portion 131. As a result, only a specific portion of the outer wall of the plunger 20 and the inner wall of the cylinder cylindrical portion 131 can be prevented from sliding. Further, a size of a gap between the outer wall of the plunger 20 and the inner wall of the cylinder cylindrical portion 131 always changes, and an oil film is always formed in the gap. Therefore, uneven wear and burnout between the plunger 20 and the cylinder 13 can be prevented.

In addition, in the present embodiment, the coil spring 90 is formed such that the upper load center C1 and the lower load center C2 coincide with each other in the center of the reciprocable range of the plunger 20, that is, at a substantially intermediate position between the bottom dead center and the top dead center (refer to FIG. 6B).

Further, in the present embodiment, the lateral force acting on the end portion of the large diameter portion 201 of the plunger 20 facing the small diameter portion 202 is reduced to 30N or less in the reciprocable range of the plunger 20 (refer to FIG. 6A).

On the other hand, as shown in FIG. 7B, in the comparative example, when the plunger 20 moves from the bottom dead center toward the top dead center and the coil spring 90 is compressed, the upper load center C1 and the lower load center C2 do not coincide with each other. At this time, as shown in FIG. 7A, the lateral force acting on the end portion of the large diameter portion 201 of the plunger 20 facing the small diameter portion 202 increases in one direction. For that reason, the plunger 20 moves toward the pressurizing chamber 103 in a state where the axis Ax2 is tilted to one side. Also, when the plunger 20 moves from the top dead center toward the bottom dead center and the coil spring 90 expands, the upper load center C1 and the lower load center C2 do not coincide with each other. Therefore, in the comparative example, when the plunger 20 reciprocates inside the cylinder cylindrical portion 131, the axis Ax2 may be always inclined to one side. In this case, a specific portion of the outer wall of the plunger 20 and the inner wall of the cylinder cylindrical portion 131, for example, only a contact portion between the outer wall of the end portion of the large diameter portion 201 facing the small diameter portion 202 and the inner wall of the cylinder cylindrical portion 131 may slide. For that reason, in the comparative example, an oil film breakage may occur at a specific portion, which may cause uneven wear and burnout of the plunger 20 and the cylinder 13.

As described above, the present embodiment is advantageous in that uneven wear and burnout between the plunger 20 and the cylinder 13 can be prevented as compared with the comparative example.

Next, the operation of the high-pressure pump 1 according to the present embodiment will be described with reference to FIG. 2.

"Intake Process"

When the supply of an electric power to the coil 45 of the electromagnetic drive portion 40 is stopped, the intake valve member 32 is urged toward the pressurizing chamber 103 by the needle urging member 37 and the needle 35. Therefore, the intake valve member 32 is separated from the intake valve seat 311, that is, is opened. In this state, when the plunger 20 moves toward the cam 19, a volume of the pressurizing chamber 103 increases, and the fuel in the intake passage 101 is suctioned into the pressurizing chamber 103.

"Metering Process"

When the plunger 20 moves away from the cam 19 in a state in which the intake valve member 32 is opened, the volume of the pressurizing chamber 103 decreases, and the fuel in the pressurizing chamber 103 flows into the fuel chamber 100 side of the intake passage 101. When the electric power is supplied to the coil 45 during a metering process, the movable core 43 is attracted to the fixed core 44 side together with the needle 35, and the intake valve member 32 contacts and closes the intake valve seat 311. When the plunger 20 moves away from the cam 19, the intake valve member 32 is closed to block a space between the pressurizing chamber 103 side and the fuel chamber 100 side of the intake passage 101, to thereby adjust the amount of fuel returned from the pressurizing chamber 103 to the fuel chamber 100 side of the intake passage 101. As a result, the amount of fuel pressurized in the pressurizing chamber 103 is determined. The intake valve member 32 is closed, to thereby terminate the metering process of returning the fuel from the pressurizing chamber 103 to the fuel chamber 100 side of the intake passage 101.

"Pressurizing Process"

When the plunger 20 further moves away from the cam 19 in a state where the intake valve member 32 is closed, a volume of the pressurizing chamber 103 decreases, and the fuel in the pressurizing chamber 103 is compressed and pressurized. When the pressure of the fuel in the pressurizing chamber 103 becomes equal to or higher than a valve opening pressure of the discharge valve member 70, the discharge valve member 70 opens and the fuel is discharged from the pressurizing chamber 103 toward the pipe 6.

When the supply of power to the coil 45 is stopped and the plunger 20 moves toward the cam 19, the intake valve member 32 opens again. As a result, the pressurizing process for pressurizing the fuel is completed, and the intake process of sucking the fuel from the fuel chamber 100 side of the intake passage 101 to the pressurizing chamber 103 side is restarted.

With the repetition of the "intake process", "metering process" and "pressurizing process" described above, the high-pressure pump 1 pressurizes and discharges the sucked fuel in the fuel tank 2 and supplies the fuel to the fuel rail 7. The supply amount of fuel from the high-pressure pump 1 to the fuel rail 7 is adjusted by controlling a supply timing of the electric power to the coil 45 of the electromagnetic drive portion 40 and the like.

In the present embodiment, the plunger 20 swings so that the axis Ax2 is tilted when the plunger 20 reciprocates inside of the cylinder cylindrical portion 131 in "an intake process", "a metering process", and "a pressurizing process". For that reason, uneven wear and burnout between the plunger 20 and the cylinder 13 can be prevented.

As described above, (1) in the present embodiment, the center of load in the virtual plane including the end face 901 of the coil spring 90 facing the pressurizing chamber 103 in the direction of the axis Ax1 is set as the upper load center C1, and the center of load on the virtual plane including the end face 902 of the coil spring 90 facing the cam 19 in the direction of the axis Ax1 is defined as the lower load center C2. When the coil spring 90 is viewed from the direction of the axis Ax1, during motion of the plunger 20 toward the pressurizing chamber 103 by the rotation of the cam 19, the upper load center C1 moves to in one direction along the circumference of the coil spring 90, and the lower load center C2 moves in an opposite direction along the circumference of the coil spring 90, and the lower load center C2 substantially coincides with the upper load center C1 and subsequently further moves in the opposite direction. For that reason, when the plunger 20 moves from the bottom dead center toward the pressurizing chamber 103, the lateral force acting on the plunger 20 from the coil spring 90 reverses after having reached zero once. As a result, the plunger 20 moves toward the pressurizing chamber 103 with the axis Ax2 tilting.

Also, with the above configuration, when the plunger 20 moves from the top dead center toward the cam 19, a lateral force acting on the plunger 20 from the coil spring 90 reverses after having reaching zero once. For that reason, the plunger 20 moves toward the cam 19 with the axis Ax2 tilting. In other words, in the present embodiment, the plunger 20 swings so that the axis Ax2 tilts when the plunger 20 reciprocates inside of the cylinder cylindrical portion 131. As a result, sliding of a specific portion of the outer wall of the plunger 20 on a specific portion of the inner wall of the cylinder cylindrical portion 131 can be prevented. Further, a size of a gap between the outer wall of the plunger 20 and the inner wall of the cylinder cylindrical portion 131 changes continuously, and an oil film is always formed in the gap. Therefore, uneven wear and burnout between the plunger 20 and the cylinder 13 can be prevented.

In addition, (2) in the present embodiment, the coil spring 90 is formed such that the upper load center C1 and the lower load center C2 coincide with each other in the center of the reciprocable range of the plunger 20. For that reason, when the plunger 20 reciprocates, the lateral force acting on the plunger 20 can be reversed in the center of the reciprocable range of the plunger 20. As a result, uneven wear and burnout between the plunger 20 and the cylinder 13 can be more effectively prevented.

In addition, (3) in the present embodiment, when the circumferential range in which the end portion 911 of the wire 91 facing the pressurizing chamber 103 is in close contact with an adjacent portion of the wire 91 in the direction of the axis Ax1 of the coil spring 90 and the wire gap therebetween is zero is defined as the upper close contact range S1. The circumferential range in which an end portion 912 of the wire 91 facing the cam 19 is in close contact with an adjacent portion of the wire 91 in the direction of the axis Ax1 of the coil spring 90 and the wire gap therebetween is zero is defined as the lower close contact range S2. When the plunger 20 moves toward the pressurizing chamber 103, the upper close contact range S1 of the coil spring 90 expands in the one direction along the circumference of the coil spring 90, and the lower close contact range S2 expands in the opposite direction along the circumference of the coil spring 90. With the above configuration, when the plunger 20 moves toward the pressurizing chamber 103 by the rotation of the cam 19, the upper load center C1 moves in the one direction along the circumference of the coil spring 90, and the lower load center C2 moves in the opposite direction along the circumference of the coil spring 90.

Other Embodiments

In the embodiment described above, the coil spring is formed such that, as viewed from the axial direction, when the plunger moves toward the pressurizing chamber by rotation of the cam, the upper load center moves in the one direction along the circumference of the coil spring, the lower load center moves in the opposite direction along the circumference of the coil spring, and the lower load center coincides with the upper load center and subsequently further moves in the opposite direction. On the contrary, in another embodiment of the present disclosure, the coil spring is formed such that the lower load center moves in the opposite direction along the circumference of the coil spring not only to exactly coincide with the upper load center, but to substantially coincide with the upper load center. Even in the configuration where the upper load center and the lower load center substantially coincide with each other, the plunger swings so that the axis is tilted when the plunger reciprocates inside the cylinder cylindrical portion. Hence, sliding of a specific portion of the outer wall of the plunger on a specific portion of the inner wall of the cylinder cylindrical portion can be prevented.

In addition, in the present embodiment described above, the coil spring is formed such that the upper load center and the lower load center coincide with each other in the center of the reciprocable range of the plunger. On the other hand, in another embodiment of the present disclosure, the coil spring is formed in any way as long as the lower load center coincides with or substantially coincides with the upper load center within the reciprocable range of the plunger and then further moves.

In another embodiment of the present disclosure, the number of turns of the wire of the coil spring is not limited to 6.3 turns, and any number of turns may be allowed.

In the embodiment described above, the wire of the coil spring is, in the free length, formed so that the end portion of the wire facing the pressurizing chamber is in contact with an adjacent portion of the wire in the axial direction of the coil spring and the end portion facing the cam is in contact with an adjacent portion of the wire. On the contrary, in another embodiment of the present disclosure, the wire of the coil spring is configured such that the end portion facing the pressurizing chamber is not in contact with the adjacent portion of the wire in the axial direction of the coil spring, and the end portion facing the cam is not in contact with the adjacent portion of the wire. Even with the configuration described above, if the plunger is located at the bottom dead center in a state where the high-pressure pump is attached to the internal combustion engine, the end portion of the wire of the coil spring facing the pressurizing chamber may contact or come into close contact with the adjacent portion of the wire of the coil spring in the axial direction, and the end portion facing the cam may contact or come into close contact with the adjacent wire. In this case, within the reciprocable range of the plunger, when the plunger moves toward the pressurizing chamber by the rotation of the cam, the upper load center moves in the one direction along the circumference of the coil spring, and the lower load center moves in the opposite direction along the circumference of the coil spring, and the lower load center is capable of coinciding with the upper load center and subsequently further moving in the opposite direction.

Further, in the embodiment described above, the upper housing, the lower housing, the holder support portion, the cylinder, and the union of the pump body are formed separately from each other. On the contrary, in another embodiment of the present disclosure, at least two members of the upper housing, the lower housing, the holder support portion, the cylinder, and the union may be integrally formed.

Further, the cylinder bottom portion may be formed separately from the cylinder cylindrical portion. Further, the cylinder bottom portion may be formed integrally with the upper housing. Alternatively, the cylinder may not have the cylinder bottom portion, and have only the cylinder cylindrical portion, and one end of the cylinder cylindrical portion may be closed by the upper housing. In this case, the pressurizing chamber is defined by the outer wall of one end of the plunger, the inner wall of the cylinder, and the inner wall of the upper housing.

Further, in another embodiment of the present disclosure, the high-pressure pump may be applied to an internal combustion engine such as a diesel engine other than a gasoline engine. In addition, the high-pressure pump may be used as a fuel pump that discharges the fuel toward a device or the like other than the engine of the vehicle.

As described above, the present disclosure is not limited to the above embodiments, but can be implemented in various configurations without departing from the spirit of the present invention.

While the present disclosure has been described with reference to embodiments thereof, it is to be understood that the disclosure is not limited to the embodiments and constructions. To the contrary, the present disclosure is intended to cover various modification and equivalent arrangements. In addition, while the various elements are shown in various combinations and configurations, which are exemplary, other combinations and configurations, including more, less or only a single element, are also within the spirit and scope of the present disclosure.

The invention claimed is:

1. A high-pressure pump for pressurizing and supplying a fuel to an internal combustion engine, comprising:

a cylinder including a cylinder cylindrical portion having a cylindrical shape;

a plunger having a reciprocable range between a top dead center position and a bottom dead center position, the plunger having a rod shape and having one end disposed to be reciprocable inside the cylinder cylindrical portion, the plunger defining a pressurizing chamber for pressurizing the fuel between an outer wall of the one end and an inner wall of the cylinder; and a coil spring formed of a wire wound in a coil shape and disposed radially outward of another end of the plunger, the coil spring urging the other end of the plunger away from the pressurizing chamber and being capable of pressing the other end of the plunger towards a cam of a driven shaft of the internal combustion engine, wherein a center of load in a virtual plane including an end face of the coil spring facing the pressurizing chamber in an axial direction is defined as an upper load center, and a center of load in a virtual plane including an end face of the coil spring facing the cam in the axial direction is defined as a lower load center, the coil spring is configured such that when viewed in the axial direction, during motion of the plunger from the bottom dead center position toward the pressurizing chamber by rotation of the cam, the upper load center moves in one direction along a circumference of the coil spring while the lower load center moves in an opposite direction along the circumference of the coil spring, wherein the coil spring is configured such that the upper load center and the lower load center coincide with each other in angular position centered at a central axis of the coil spring within the reciprocable range of the plunger, and wherein the upper load center and the lower load center subsequently further move in the one direction and the opposite direction, respectively, as the plunger continues to move towards a top dead center position of the reciprocable range of the plunger.

2. The high-pressure pump according to claim 1, wherein the coil spring is configured such that the upper load center and the lower load center coincide with each other in angular position at a center of the reciprocable range of the plunger.

3. The high-pressure pump according to claim 1, wherein a circumferential range of the wire where an end portion of the wire facing the pressurizing chamber is in contact with an adjacent portion of the wire in the axial direction of the coil spring wherein a wire gap therebetween is zero is defined as an upper close contact range, and a circumferential range of the wire where an end portion of the wire facing the cam is in close contact with an adjacent portion of the wire in the axial direction of the coil spring wherein a second wire gap therebetween is zero is defined as a lower close contact range, the coil spring is configured such that, when the plunger moves toward the pressurizing chamber, the upper close contact range of the coil spring expands in the one direction along the circumference of the coil spring, and the lower close contact range expands in the opposite direction along the circumference of the coil spring.

* * * * *